United States Patent [19]

Foster

[11] 3,939,055

[45] Feb. 17, 1976

[54] LAMINATED ASBESTOS DIAPHRAGM

[75] Inventor: Robbie T. Foster, Corpus Christi, Tex.

[73] Assignee: PPG Industries, Inc., Pittsburgh, Pa.

[22] Filed: Oct. 3, 1973

[21] Appl. No.: 403,137

[52] U.S. Cl. ..... 204/295; 162/105; 162/106; 162/123

[51] Int. Cl.[2] ..... C25B 13/06; B32B 19/08

[58] Field of Search ..... 204/295; 162/105, 106, 162/123

[56] References Cited

UNITED STATES PATENTS

| | | | |
|---|---|---|---|
| 982,037 | 1/1911 | Crocker | 204/295 X |
| 1,039,266 | 9/1912 | Dieffenbach | 204/295 |
| 1,082,286 | 12/1913 | Ruhm | 204/295 X |
| 1,097,826 | 5/1914 | Townsend et al. | 204/295 UX |
| 1,865,152 | 6/1932 | Stuart | 204/295 X |

FOREIGN PATENTS OR APPLICATIONS

| | | | |
|---|---|---|---|
| 5,198 | 3/1894 | United Kingdom | 204/295 |

*Primary Examiner*—F. C. Edmundson
*Attorney, Agent, or Firm*—Richard M. Goldman

[57] ABSTRACT

Disclosed is a method of preparing an asbestos diaphragm where alkali metal ions are provided within the fibrous asbestos diaphragm, the diaphragm is heated to form an alkali metal silicate layer on the asbestos fibers, and thereafter a further layer of asbestos is deposited on the diaphragm.

3 Claims, No Drawings

LAMINATED ASBESTOS DIAPHRAGM

BACKGROUND OF THE INVENTION

Diaphragm cells useful for the electrolysis of brines and the formation of chlorine and caustic soda have an anolyte chamber and a catholyte chamber. The anolyte chamber contains an anolyte solution of sodium chloride at a pH of from about 3.0 to about 4.5. Inside the anolyte chamber is an anode at which chlorine is evolved. The catholyte chamber of a sodium chloride chlor-alkali cell contains from about 10 to 15 weight percent sodium hydroxide while the catholyte chamber of a potassium chloride chlor-alkali cell may contain as much as 25 weight percent potassium hydroxide. The catholyte liquor contains the alkali metal hydroxide, and the alkali metal chloride. Alkali metal hydroxide is formed in the catholyte and hydrogen gas is evolved at the cathode.

In the operation of a sodium chloride diaphragm cell, brine containing approximately 300 to 315 grams per liter of sodium chloride is fed into the anolyte chamber. At the anode, the reaction $2Cl^- \rightarrow Cl_2 + 2e^-$ takes place.

The anolyte liquor passes from the anolyte chamber through the diaphragm into the catholyte chamber, and a catholyte product containing from approximately 110 to approximately 150 grams per liter of sodium hydroxide and from approximately 120 to approximately 200 grams per liter of sodium chloride is recovered. In the catholyte chamber, the reaction $2H_2O + 2e^- \rightarrow 2OH^- + H_2$ takes place.

Typically, diaphragms for chlorine cells have been prepared from asbestos. Most commonly, the asbestos is chrysotile asbestos. The chrysotile asbestos is used to provide a diaphragm having a thickness of from about one-eighth inch to about one-fourth inch. Chrysotile asbestos diaphragms generally have a service life of about 6 months.

It is necessary to periodically remove the diaphragm cell from service in order to remove the old diaphragm from the cathodes, and install a new diaphragm on the cathodes. This periodic removal of the cell from service results in a consequent loss of production in order to carry out a labor-intensive cell renewal operation. In the past, when diaphragm cells used graphite anodes, diaphragm renewal could be coordinated with anode renewal. However, metallic anodes, e.g., coated titanium anodes, have replaced graphite anodes to a considerable degree. While graphite anodes have a service life of from about 4 to about 8 months, coated metal anodes have a longer life, e.g., 3 or 4 or more years. Accordingly, the renewal of the diaphragms has become a principal factor in cell outage.

SUMMARY

It has now unexpectedly been found that a particularly long-lived diaphragm may be provided by preparing a chrysotile asbestos fibrous mat containing alkali metal ions therein and heating the alkali metal ion containing fibrous mat to a temperature sufficient to dry the mat and cause the alkali metal ion to react with the asbestos. This is believed to displace the magnesium ion from the surface of the chrysotile asbestos fibers to form an alkali metal silicate layer on the asbestos fibers which, upon contact with the acid anolyte, forms a dense, uniform silica layer on the surface of the original asbestos fibers thereby providing a long-lived diaphragm. Typically, the alkali metal is sodium and the alkali metal silicate is sodium silicate.

Thereafter, a further thin film of asbestos is deposited atop the asbestos diaphragm on the side intended to face the anolyte. It is believed that this further asbestos film or coat acts as a self-curing layer for pinholes, imperfections, and the like.

DETAILED DESCRIPTION

According to this invention, an asbestos diaphragm is prepared by providing asbestos containing an alkali metal ion, such as an alkali metal hydroxide, or an alkali metal chloride, e.g., sodium hydroxide, sodium chloride, potassium hydroxide, or potassium chloride or a combination thereof. The alkali metal ion containing and hydroxyl ion containing asbestos is heated to a temperature sufficient to initiate the displacement of magnesium from the asbestos and the formation of an alkali metal silicate surface or film on the asbestos and is maintained at or above such temperature long enough to form the alkali metal silicate. Thereafter, a thin film, layer, coating, or laminate of asbestos, e.g., from about 0.01 to about 0.1 pounds of asbestos per square foot of diaphragm area is deposited atop the diaphragm, i.e., the first asbestos mat, sheet, or member, on the anolyte facing side thereof. Upon contact with the anolyte liquor, the alkali metal silicate is believed to form a particularly tough, adherent silica layer which is substantially inert to anolyte liquor. That is, the silica layer is more inert ot anolyte liquor than is a conventional diaphragm. The outer asbestos layer is believed to function as a self-curing film or layer, reducing the effects of pinholes and imperfections in the first asbestos layer.

As used herein a fibrous mat is an asbestos member, formed from asbestos fibers. As used herein a diaphragm is an asbestos member, either a fibrous mat or asbestos paper, characterized by chemical resistance to anolyte liquors and catholyte liquors, and electrolyte permeability.

In preparing a diaphragm according to one exemplification of this invention, an aqueous slurry containing asbestos and alkali metal ion is prepared. The slurry is drawn through an electrolyte-permeable cathode member and the asbestos deposited on the cathode member thereby forming a fibrous asbestos mat. Thereafter the alkali metal ion containing fibrous asbestos mat is heated whereby to form the alkali metal silicate.

The asbestos most commonly used is chrysotile asbestos. Typically, the asbestos is Quebec Asbestos Producers' Association Quebec Screen Test grades 4D or 4K or a mixture of grades 3T and 4T.

Typically, the slurry contains from about 0.5 to about 2.0 weight percent of asbestos. Concentrations of asbestos lower than about 0.5 weight percent, while satisfactory in providing a diaphragm according to this invention, require large throughputs of slurry in order to build up a satisfactory thickness of asbestos. Asbestos concentrations greater than about 2 weight percent asbestos in the slurry, generally result in substantial settling out of the asbestos in the slurry and a non-uniform diaphragm.

The alkali metal ion content of the slurry is provided by a basic solution of an alkali metal compound. That is, the alkali metal ion is provided by a solution having a pH greater than 7.0, and preferably greater than 10. The alkali metal ion content may be provided by a solution of a high pH alkali metal salt of a weak acid, such as sodium carbonate, sodium hydrogen carbonate, sodium acetate, or the like. Alternatively, the alkali metal content may be provided by a solution containing the hydroxide and a substantially completely ionized salt, as sodium hydroxide and sodium chloride. The alkali metal ion may also be provided by aqueous alkali metal hydroxide. Alternatively, potassium hydroxide or potassium chloride may be used to form the slurry.

Generally, sodium hydroxide is preferred as the alkali metal ion source because of its ready availability. While the method of preparing the diaphragm is described with reference to sodium hydroxide, it is to be understood that sodium chloride may also be included in the slurry with satisfactory results. The sodium ion content in the slurry should be such as is normally provided by a 10 to 50 weight percent aqueous solution of sodium hydroxide.

The slurry, preferably containing from about 0.5 to about 2 weight percent of chrysotile asbestos and from about 10 to about 25 or 50 weight percent of sodium hydroxide is used to prepare an asbestos diaphragm. The asbestos diaphragm is drawn onto a liquid permeable cathode member by methods well known in the art.

The cathode member itself is an alkali-resistant, catholyte-resistant, hydrogen-resistant, electroconductive metal having a low hydrogen overvoltage. Most commonly, iron or steel is used in fabricating the cathode member.

The cathode member is further characterized in that it is liquid permeable, i.e., electrolyte permeable, and gas permeable. The property of permeability may be provided by using a wire mesh cathode or by using a perforated plate cathode.

According to an exemplification of this invention, an alkali metal ion containing fibrous asbestos mat may be deposited on a cathode member by inserting the cathode member in an alkali metal ion and $OH^-$ ion containing aqueous slurry of asbestos and drawing a vacuum within the cathode member. By "vacuum" is meant a pressure differential between the inside and outside of the cathode. The vacuum draws the slurry through the cathode member, depositing the asbestos fibers on the external surfaces thereof. Typically, a vacuum of from about 15 to about 25 inches of mercury is provided within the cathode member for a period of from about 10 minutes to about 25 minutes. In this way, a fibrous asbestos mat having a thickness of from about one-eighth inch to about 3/16 inch and a weight of from about 0.3 pounds per square foot to about 0.4 pounds per square foot is provided.

While a preferred exemplification of this invention utilizes a deposited asbestos diaphragm, it should be understood that an electrolyte permeable diaphragm may also be provided using asbestos paper. According to an exemplification of this invention where an asbestos paper diaphragm is used, the alkali metal ion and $OH^-$ ion may be introduced into the asbestos paper by forming the paper in an alkali metal ion containing slurry. Alternatively, an alkali metal ion containing solution, e.g., aqueous sodium hydroxide may be forced through the asbestos paper after the formation thereof.

When sodium hydroxide is used, the asbestos diaphragm, whether a deposited fibrous mat or paper, should typically contain from about 5 to about 50 weight percent of sodium hydroxide on an anhydrous basis and a dry asbestos basis, and preferably about 35 to about 40 weight percent sodium hydroxide, basis anhydrous sodium hydroxide and dry asbestos. This corresponds to from approximately 10 to about 100 percent and preferably from about 60 to about 80 percent of the stochiometric amount of sodium ion for one mole of sodium ion to react with one mole of silicate ion to form one mole of $Na_2O \cdot SiO_2$.

Lesser or greater amounts of sodium ion may be present in the fibrous asbestos mat, prepared as described above. Lesser amounts of sodium ion present in a fibrous asbestos mat, prepared as described above, while providing some increased life, may not provide an economically significant increase in diaphragm life. Greater amounts of sodium ion present in a fibrous asbestos mat, prepared as described above, while useful in providing increased diaphragm life, may tend to excessively tighten the diaphragm, causing it to behave as a permionic membrane, and may, at extremely high sodium ion concentrations actually reduce the strength of the diaphragm.

The sodium ion containing, asbestos member, either a fibrous mat or paper, is heated to a temperature sufficient to result in the formation of sodium silicate and is maintained at or above such temperature long enough to effect the desired degree of reaction. While not wishing to be bound by this explanation, it is believed that the following reaction occurs within the fibrous asbestos mat upon heating:

$$8M\ OH + Mg_6(OH)_8Si_4O_{10} \rightarrow 4M_2SiO_3 + 6Mg(OH)_2 + 2H_2O$$

where M is an alkali metal, generally sodium or potassium, and most commonly sodium.

While the heating stage itself may be in one or two stages, it can be characterized as encompassing two phases, a partial dehydration phase believed to drive off some of the water present therein while physically rearranging and compacting the asbestos fibers, and a reaction phase believed to form the alkali metal silicate in a form that reacts with anolyte liquor to form a silica which is less subject to attack by brine than chrysotile asbestos. In the heating stages of the method of this invention, the duration of heating, the temperature of heating, the initial moisture content of the asbestos, and the flow of heated air, if any, through the diaphragm, are inter-related.

Generally, the temperature during the first phase of heating should be above about 70°C, which temperature corresponds to the temperature at which some compacting and rearrangement of the asbestos fibers is first observed. Temperatures above about 110°C should be avoided in the early stages of heating, as such temperatures result in the delamination of wet diaphragms and subsequent high cell voltage and low current efficiency. Generally, the fibrous asbestos mat should be dried to a water content of less than 2.0 weight percent water, and preferably to 1.0 weight percent water, or even lower, e.g., 0.5 weight percent water. The temperature of the first heating stage should be above 50°C and below 110°C, and generally from about 70° to 110°C. The length of the first heating should range from about 72 or more hours at 50°C and about 24 hours at 70°C to about 1 to 4 hours at 110°C, and should be long enough to permit the second stage of heating to be substantially in the absence of entrapped or entrained water.

While a first heating stage is referred to herein, it is to be understood that the first heating stage functions as a drying phase and may even be dispensed with if a vacuum is first applied to the cathode compartment to dry, physically rearrange, and compact the fibers. In such case, the vacuum should be a full vacuum, i.e., 20or more inches of mercury.

The first heating stage, or dehydration stage, is followed by a subsequent heating stage to form the desired silicate. This second heating stage is conducted at temperatures above about 110°C, e.g., from about 110° to about 280°C, and preferably from about 140° to about 210°C.

At temperatures below 140°C, approximately several days, e.g., 4 or 5 days, may be required for the alkali metal silicate to approach stochiometric conversion to the desired form, while at temperatures at or above 180°C only a few hours, e.g., 2 hours with low alkali metal ion contents, to about 4 to 6 hours, are normally required for the formation of the desired form of the alkali metal silicate.

While the flow of heated air through the electrolyte permeable fibrous mat does not result in any decrease in the time required for silicate formation, it does result in removal of entrapped water, thereby reducing overall drying time.

The heating may also be carried out under reduced pressure to speed the drying time.

In the preparation of a diaphragm according to a preferred exemplification of this invention, the asbestos mat is maintained between about 50° and about 110°C for a sufficient time to allow the evaporation of the entrapped water, e.g., at least about 1 hour, and preferably four or more hours, and frequently 72 to 96 hours. Maintaining the asbestos mat between about 50° and 110°C may be accomplished by slowly heating the diaphragm from or below 50°C to or above 110°C, or by maintaining the asbestos mat at a fixed temperature or plurality or sequence of fixed temperatures between 50° and 110°C. Thereafter the asbestos mat is maintained above 110°C, e.g., from about 110° to about 280°C, and preferably from about 140° to about 210°C. Maintaining the asbestos mat above about 110°C may be accomplished by maintaining the asbestos mat at a single temperature above 110°C, e.g., 140° C, or 180°C, or by maintaining the asbestos at a sequence of temperatures above about 110°C. The asbestos mat is maintained above 110°C long enough for substitution of the magnesium ion by the alkali metal ion and the formation of the alkali metal silicate, e.g., from about 2 or 4 or 6 hours to several days, e.g., 96 or 120 or more hours. The mat is maintained above 110°C in the substantial absence of entrapped or entrained water.

A surface film of alkali metal silicate is formed on the asbestos fibriles and in some instances on the individual fibers thereof. The surface film may exist as a thin layer or coating on the exterior of the individual fibers or even as a monolayer of alkali metal silicate. Alternatively, the alkali metal silicate layer may extend into, and in fact all the way through the individual asbestos fibers.

According to this invention, the alkali metal silicate layer is provided on the asbestos fibers. For example, when the alkali metal is sodium, the sodium silicate has the stochiometric formula: $(Na_2O)\ (SiO_2)_n$ where n is from about 1 to about 4 or more. However, it should be understood that this is only a stochiometric representation of a complex silicate polymer containing many $(Na_2O)$ units and many $(SiO_2)$ units.

After the asbestos mat is heat treated, the second layer of asbestos may be applied directly thereto. Alternatively, the asbestos mat may be treated, e.g., with a silicate solution as described in the commonly assigned, copending application Ser. No. 343,600, filed Mar. 31, 1973, of Franklin Strain for *Silicate Treated Asbestos Diaphragms for Electrolytic Cells*, or with a perfluorinated sulfonyl fluoride type co-polymer as described in the commonly assigned, copending application Ser. No. 300,151, filed Oct. 24, 1972, of Robbie T. Foster and William Bruce Darlington for *Diaphragms for Electrolytic Cells*.

After heat treating, and any subsequent treatment, e.g., with resins or silicate solution, or the like, the diaphragm, on a pervious support means, e.g., a cathode, is inserted into an asbestos slurry, e.g., a slurry of from about 0.1 to about 2 weight percent chrysotile asbestos in a cell liquor containing 7 to 12 weight percent sodium chloride, and about 12 to 20 weight percent sodium hydroxide. A pressure differential is established across the support means, e.g., from about 5 to about 25 inches of mercury, whereby to force the slurry through the treated asbestos diaphragm and deposit an additional film, layer, coating, or lamination of asbestos atop the diaphragm. This further layer of asbestos, applied after heating the diaphragm and prior to placing the diaphragm-cathode assembly in the cell, need only be a thin layer of asbestos, e.g., from about 0.01 to about 0.1 pounds of asbestos per square foot, and preferably from about 0.03 to about 0.07 pounds of asbestos per square foot.

Diaphragms prepared as described above are characterized by a very thin gel layer imparting self-healing properties to the diaphragm, and by significantly reduced swelling in cell service.

The "gel layer" is described by Kircher, "Electrolysis of Brines in Diaphragm Cells," in Sconce, ed., *Chlorine*, A.C.S. Monograph Series, No. 54, Reinhold Publishing Company, New York, N.Y. (1962), at page 105, as a layer "formed within the asbestos mat which is sensitive to pH and which tends to dissolve, precipitate, and reform depending upon flow rate and salt content and pH of the flowing liquor." As a rule, in an untreated diaphragm the gel layer extends approximately 0.08 to 0.12 inch into the diaphragm from the anolyte side. The alkali metal ion treatment and heating of the diaphragm according to this invention appears to substantially retard the formation of the gel layer. Diaphragms prepared according to this invention are characterized by increased physical strength so as to withstand the erosiveness of the gas bubble filled anolyte stream flowing against it.

When the diaphragm is contacted with a low pH solution, e.g., anolyte liquor, having a pH of about 4.5 and preferably 4.0 or even lower, e.g., 3.5 or 2.9 or lower, the silicate of the underlying asbestos reacts to form a particularly tough adherent silica that is thereafter substantially inert to attack by the anolyte, while the outer asbestos coating provides a self-healing film.

Diaphragms produced as described above are characterized by long life and mechanical durability. Such diaphragms have a service life in excess of one year and frequently in excess of 18 months or longer. Such diaphragms are further characterized by a transverse wet tear strength in excess of 4.4 pounds per inch, compared to an effectively zero wet tear strength for untreated asbestos diaphragms. The following example is illustrative.

EXAMPLE

Two asbestos diaphragms were prepared by drawing chrysotile asbestos from a cell liquor slurry, heating to substantial dryness, subsequent heating, and treatment with a perfluorinated sulfonic acid resin. A second coat of asbestos was then applied to one of the diaphragms, and both were tested in laboratory cells.

A slurry was prepared containing 15 weight percent sodium chloride, 10 weight percent sodium hydroxide, and 1.5 weight percent Johns-Manville Grade chrysotile asbestos (1 part 3T, 2 parts 4T12).

Chrysotile asbestos was then forced from the slurry onto identical cathodes of a pair of laboratory diaphragm cells. Each laboratory electrolytic diaphragm cell had a 1000 cubic centimeter capacity catholyte compartment fabricated of 10 gauge steel sheet, and an anolyte compartment having a 1000 cubic centimeter capacity fabricated of chlorinated polyvinyl chloride. The anode, measuring 5 inches by 7 inches, was 1/16 inch Grade-1 titanium mesh coated with platinum and iridium. The cathode was 6 by 6 mesh to the inch, 3/16 inch, number 13 steel screen. The gap between the anode and the cathode in each assembled cell was adjusted to three-eighths inch.

Asbestos mats were applied to the cathodes by applying a pressure differential of 25 inches of mercury across the cathode. In this way, an asbestos mat of 0.35 pounds per square foot was applied. The asbestos mats were partially dried by forcing air through at a pressure differential of 25 inches of mercury for 25 minutes.

The partially dried asbestos mats were then soaked in cell liquor and a pressure differential of 1 to 2 inches of mercury was applied across the mat, forcing cell liquor through the mat. The asbestos mats were then removed from the cell liquor and heated to 100°C for 4 hours under a pressure differential of 2 inches of mercury. They were then heated to 180°C for 20 hours under a pressure differential of 2 inches of mercury.

Thereafter, both asbestos mats were treated with a 0.13 weight percent solution of DuPont "Nafion" (TM) perfluorocarbon sulfonyl fluoride copolymer in ethanol, to provide 8 grams of Nafion (TM) per pound of asbestos. The Nafion was heat set by heating the asbestos mats to 100°C for 2 hours.

One of the asbestos mats, mounted on a mesh cathode, was then inserted in a slurry of 5 grams per liter of Johns-Manville 4T-12 chrysotile asbestos in an aqueous solution of 10 weight percent sodium hydroxide and 15 weight percent sodium chloride. A pressure differential of 25 inches of mercury was applied across the diaphragm and a layer of 0.05 pounds of asbestos per square foot was forced onto the diaphragm.

Thereafter, the two electrolytic cells were assembled, a brine feed of approximately 310 grams per liter of sodium chloride fed to the cells, and electrolysis commenced. The results shown in Table I were obtained.

Table I

Comparison of Diaphragms With and Without A Second Asbestos Layer

| | Diaphragm with second layer of asbestos | Diaphragm without second layer of asbestos |
|---|---|---|
| Anolyte Head (inches of water) | 29 inches | 27 inches |
| Anode Current Efficiency | 96% | 92% |
| Cathode Current Efficiency | 94% | 88% |
| Cell Voltage (volts) | 3.40v | 3.48v |
| Percent $H_2$ in $Cl_2$ | 0.05% | 0.05% |
| Percent $O_2$ in $Cl_2$ | 0.51% | 2.37% |

Although the present invention has been described with reference to specific details of particular embodiments thereof, it is not intended thereby to limit the scope of the invention except insofar as specific details are recited in the appended claims.

I claim:

1. A laminated asbestos diaphragm comprising;

1. an asbestos mat, which mat has been treated by the process comprising:
   a. drawing an aqueous alkali metal hydroxide solution through said mat to provide alkali metal hydroxide within said mat;
   b. rendering the mat substantially free of water; and
   c. thereafter heating the mat in the substantial absence of water to between 110° and 280°C. for more than 2 hours;
2. a layer of asbestos on said mat, said layer having been deposited by drawing a slurry of asbestos fibers through said previously heated asbestos mat thereby depositing asbestos fibers on said asbestos mat.

2. The diaphragm of claim 1 wherein said first layer contains from about 0.3 to about 0.4 pounds of asbestos per square foot.

3. The diaphragm of claim 1 wherein said second layer contains from about 0.01 to about 0.10 pounds of asbestos per square foot.

* * * * *